US005967347A

United States Patent [19]

Miyata et al.

[11] Patent Number: 5,967,347

[45] Date of Patent: Oct. 19, 1999

[54] LOWERING COLLISION AVOIDANCE DEVICE OF CRANE

[75] Inventors: Noriaki Miyata; Toshio Taguchi, both of Hiroshima, Japan

[73] Assignee: Mitsubishi Heavy Industries, Ltd., Japan

[21] Appl. No.: 08/985,241

[22] Filed: Dec. 4, 1997

[30] Foreign Application Priority Data

Dec. 6, 1996 [JP] Japan ..... 8-326575

[51] Int. Cl.[6] ..... B66C 13/48

[52] U.S. Cl. ..... 212/286; 212/275; 212/276

[58] Field of Search ..... 212/272, 273, 212/275, 276, 281, 270, 271, 286

[56] References Cited

U.S. PATENT DOCUMENTS 5,048,703 9/1991 Tax et al. .

FOREIGN PATENT DOCUMENTS

| | | | |
|---|---|---|---|
| 0596330 | 5/1994 | European Pat. Off. . | |
| 29510031 | 12/1995 | Germany . | |
| 1-281294 | 11/1989 | Japan | 212/275 |
| 4-1822299 | 6/1992 | Japan | 212/275 |
| 2295596 | 6/1996 | United Kingdom . | |

*Primary Examiner*—Thomas J. Brahan

*Attorney, Agent, or Firm*—Rothwell, Figg, Ernst & Kurz, p.c.

[57] ABSTRACT

A lowering collision avoidance device includes a hoisting accessory swing detector, a rope winding speed detector, an arithmetic unit, a rope winding speed controller, and if desired, a rope length detector. The arithmetic unit computes a command value for the lowering speed based on the results of comparison between the amount of swing of a hoisting accessory detected by the hoisting accessory swing detector and a predetermined threshold level or a plurality of predetermined threshold levels; the direction of changes in the amount of swing computed based on the amount of swing of the hoisting accessory; and the lowering speed detected by the rope winding speed detector. The rope winding speed controller controls the lowering speed based on this command value. The arithmetic unit also predicts maximum displacement by swing based on the amount of swing of the hoisting accessory, the positional change rate of the hoisting accessory computed based on this amount of swing, and the period of vibration of the hoisting accessory computed from the rope length detected by the rope length detector, and computes a command value for the lowering speed based on the results of comparison between the maximum displacement and a predetermined threshold level. The rope winding speed controller controls the lowering speed based on this command value as well.

10 Claims, 6 Drawing Sheets

LOWERING COLLISION AVOIDANCE DEVICE OF CRANE

BACKGROUND OF THE INVENTION

This invention relates to a lowering collision avoidance device of a crane. More particularly, the invention concerns the device useful when applied to a container handling crane installed in a container yard such as a port yard.

In a container yard such as a port yard, containers transported there by a chassis, an automated guided vehicle (AGV) or the like are handled, one by one, by a container handling crane installed in the container yard so as to be stacked in layers (on other containers) or placed on the floor (lowered onto the ground) in the container yard.

FIG. 6 is an explanation drawing showing the constitution of a conventional container handling crane. As illustrated in this drawing, the container handling crane has a structure comprising a girder 1 provided horizontally above a container yard, legs 2 supporting the girder 1, and running systems 3 provided at the lower ends of the legs 2, as well as a trolley 4 mounted on the girder and running along the girder 1, a hoisting/lowering device 5 mounted on the trolley 4, a hoisting/lowering drive motor 7 for driving the hoisting/lowering device 5, a rope 6 taken up or paid out by the hoisting/lowering device 5, a hoisting accessory 10 suspended from the hoisting/lowering device 5 via the rope 6, and a rope winding speed controller 20 for controlling the hoisting/lowering drive motor 7.

In placing a container 11, for example, at a target position 12 (on a container 21) between adjacent containers 22 and 23 stacked high in layers, the container handling crane acts as follows:

When a chassis or AGV 30 bearing the container 11 stops beside the container handling crane, the trolley 4 is moved along the girder 1 and halted directly above the chassis or AGV 30.

Then, the hoisting/lowering device 5 is driven by the hoisting/lowering drive motor 7 to pay out the rope 6, thereby placing the hoisting accessory 10 on the container 11. The container 11 is held by a twist lock mechanism (not shown), and the rope 6 is taken up by the hoisting/lowering device 5 to lift (hoist) the container 11 together with the hoisting accessory 10.

After or simultaneously with hoisting the container 11, the trolley 4 is moved along the girder 4. After or simultaneously with moving the trolley 4, the rope 6 is paid out by the hoisting/lowering device 5 to move down (lower) the container 11 along with the hoisting accessory 10 and bring it to the target position 12.

In other words, when the container 11 is to be carried to the target position 12, the container 11 is hoisted once to a higher position in order to escape a stack of containers lying in the way. During or after this hoisting, the trolley 4 is moved to a targeted position above the container 21. While or after moving the trolley 4, the container 11 is lowered to be put to the target position 12.

During the foregoing process, the container 11 is suspended by the rope 6, and so moves while swinging horizontally under the influence of the wind or changes in the speed of the trolley 4. To reduce the amount of swing of the container 11, various ideas have been incorporated, such as the provision of an auxiliary rope or the use of a method for automatically controlling the acceleration of the trolley 4. However, as long as the container 11 is suspended by the rope 6, it is impossible, in principle, to eliminate the swing of the container 11 completely. Particularly in a strong wind, its swing is marked.

Thus, when the container 11 is to be lowered to a place where the containers 22, 23 are stacked high in layers in adjacent rows as shown in FIG. 6 (i.e., to the target position 12), there is a possibility that the container 11, while being lowered, will collide with a container in the adjacent row particularly when a strong wind is blowing. A collision, if any, may cause damage to the container or its fall.

To avoid this accident, customary practice has been as follows: When lowering a container to a place where containers are piled high in layers in adjacent rows, namely, during its intrusion into a canyon, an operator reduces the container lowering speed, and performs an operation while making sure that this container does not collide with the adjacent container. If the container swings markedly and may collide with the adjacent container, the operator terminates its lowering immediately.

This conventional method, however, posed the problem of taking time for lowering the container, making it impossible to shorten the cycle time.

SUMMARY OF THE INVENTION

The present invention has been accomplished in the light of the above-described earlier technologies. Its object is to provide a lowering collision avoidance device of a crane which can rapidly lower a carried article (e.g., a container) to a place, where there are obstacles such as carried articles stacked adjacently in layers, while preventing the collision of the article with these obstacles.

The invention has attained this object by utilizing the facts that a container suspended by a rope vibrates with a long period like a pendulum and cannot cause abrupt changes in position owing to its inertia. The invention has the following constitution:

A first aspect of the invention for attaining the above object is a lowering collision avoidance device of a crane, the crane comprising a hoisting/lowering drive motor, a hoisting/lowering device driven by the hoisting/lowering drive motor, a rope taken up or paid out by the hoisting/lowering device, and a hoisting accessory suspended from the hoisting/lowering device via the rope and hoisted or lowered by the hoisting/lowering device, the crane lowering a carried article held by the hoisting accessory, together with the hoisting accessory, to a target position in a stack of other carried articles or to a floor position, the lowering collision avoidance device being adapted to prevent the collision of the carried article during lowering with obstacles such as the other carried articles stacked in layers adjacent to the target position, the lowering collision avoidance device comprising:

- a hoisting accessory swing detector for detecting the swing of the hoisting accessory;
- a speed detector for detecting the lowering speed of the carried article; and
- a controller for controlling the hoisting/lowering drive motor to control the lowering speed of the carried article, the controller performing its control action based on the results of comparison between the amount of swing of the hoisting accessory detected by the hoisting accessory swing detector and a predetermined threshold level or a plurality of predetermined threshold levels; the direction of changes in the amount of swing computed based on the amount of swing of the hoisting accessory; and the lowering speed detected by the speed detector.

A second aspect of the invention is the lowering collision avoidance device of a crane as the first aspect of the invention wherein a rope length detector is provided for detecting the length of the rope, and the controller predicts maximum displacement by swing of the hoisting accessory based on the amount of swing of the hoisting accessory detected by the hoisting accessory swing detector, the positional change rate of the hoisting accessory computed based on the amount of swing of the hoisting accessory, and the period of vibration of the hoisting accessory computed from the rope length detected by the rope length detector, and the controller controls the hoisting/lowering drive motor based on the results of comparison between the predicted maximum displacement by swing and a predetermined threshold level, thereby controlling the lowering speed of the carried article.

Thus, the lowering collision avoidance device of a crane as the first aspect of the invention controls the lowering speed based on the results of comparison between the amount of swing of the hoisting accessory and a threshold level or a plurality of threshold levels, the direction of changes in the amount of swing of the hoisting accessory, and the lowering speed. Assume, here, that a carried article is lowered, together with the hoisting accessory, to be placed in a stack of layers or on the floor at a site where there are obstacles such as carried articles stacked adjacently in layers. At this time, when the swing of the hoisting accessory decreases during the lowering of the carried article even if the current swing of the hoisting accessory (i.e., the swing of the carried article) is marked, the lowering speed need not be decreased. Moreover, maximum continued operation can be carried out to the extent that the carried article will not collide with the adjacent obstacle. In case a real risk of collision exists, the lowering of the carried article can be stopped.

According to the lowering collision avoidance device of a crane as the second aspect of the invention, maximum displacement by the swing of the hoisting accessory is predicted. Based on the results of comparison between the predicted maximum displacement by swing and a predetermined threshold level, the lowering speed is controlled. Thus, collision between the lowered carried article and the adjacent obstacle can be prevented more reliably.

DETAILED DESCRIPTION OF THE PREFERRED EMBODIMENTS

Figure 6:
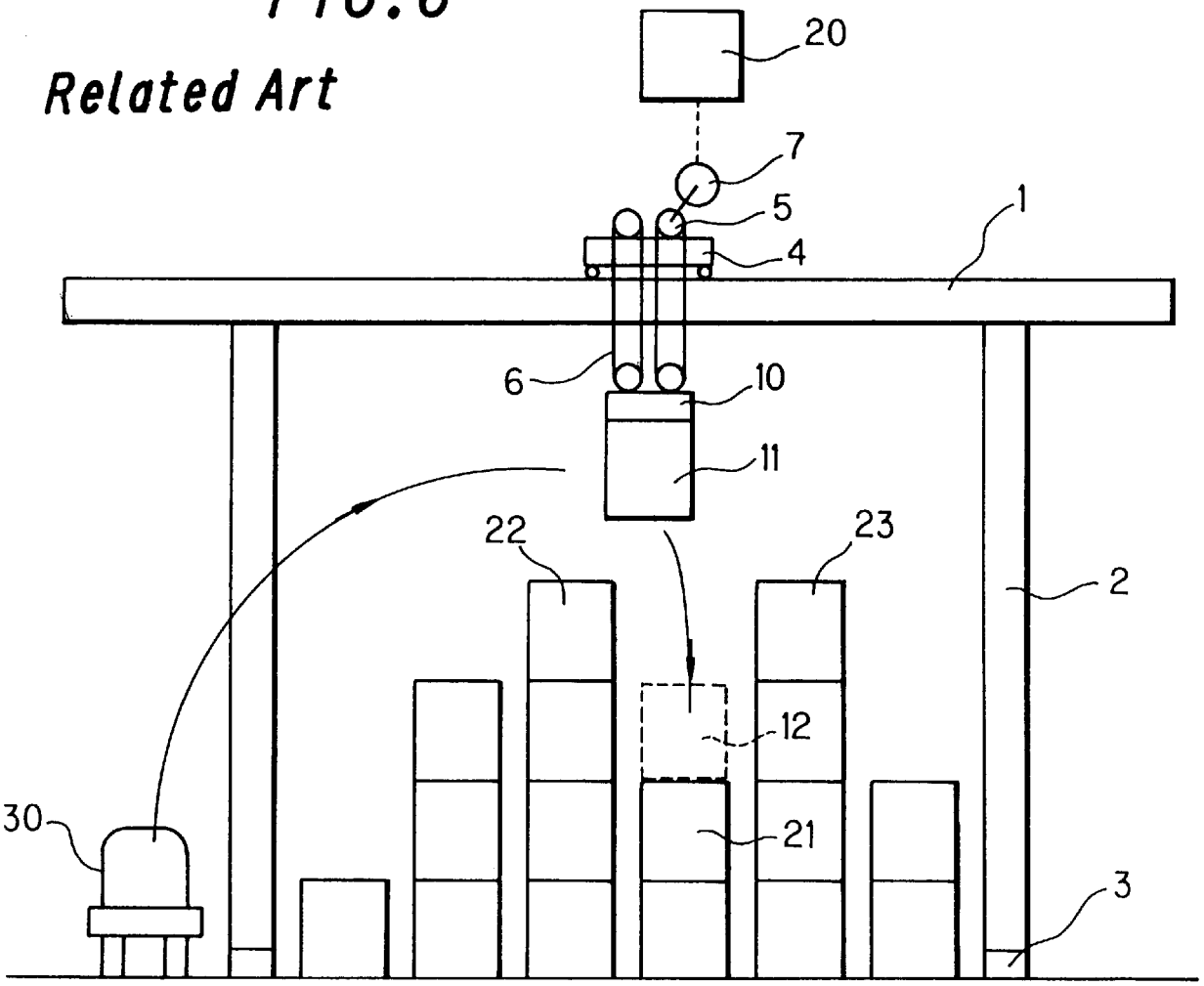
FIG. 6 Related Art
FIG. 6 is an explanation drawing showing the constitution of a conventional container handling crane.

Embodiments of the present invention will now be described in detail with reference to the accompanying drawings. The same parts as in the related art (FIG. 6) will be assigned the same numerals, and overlapping detailed descriptions will be omitted.

Figure 1:
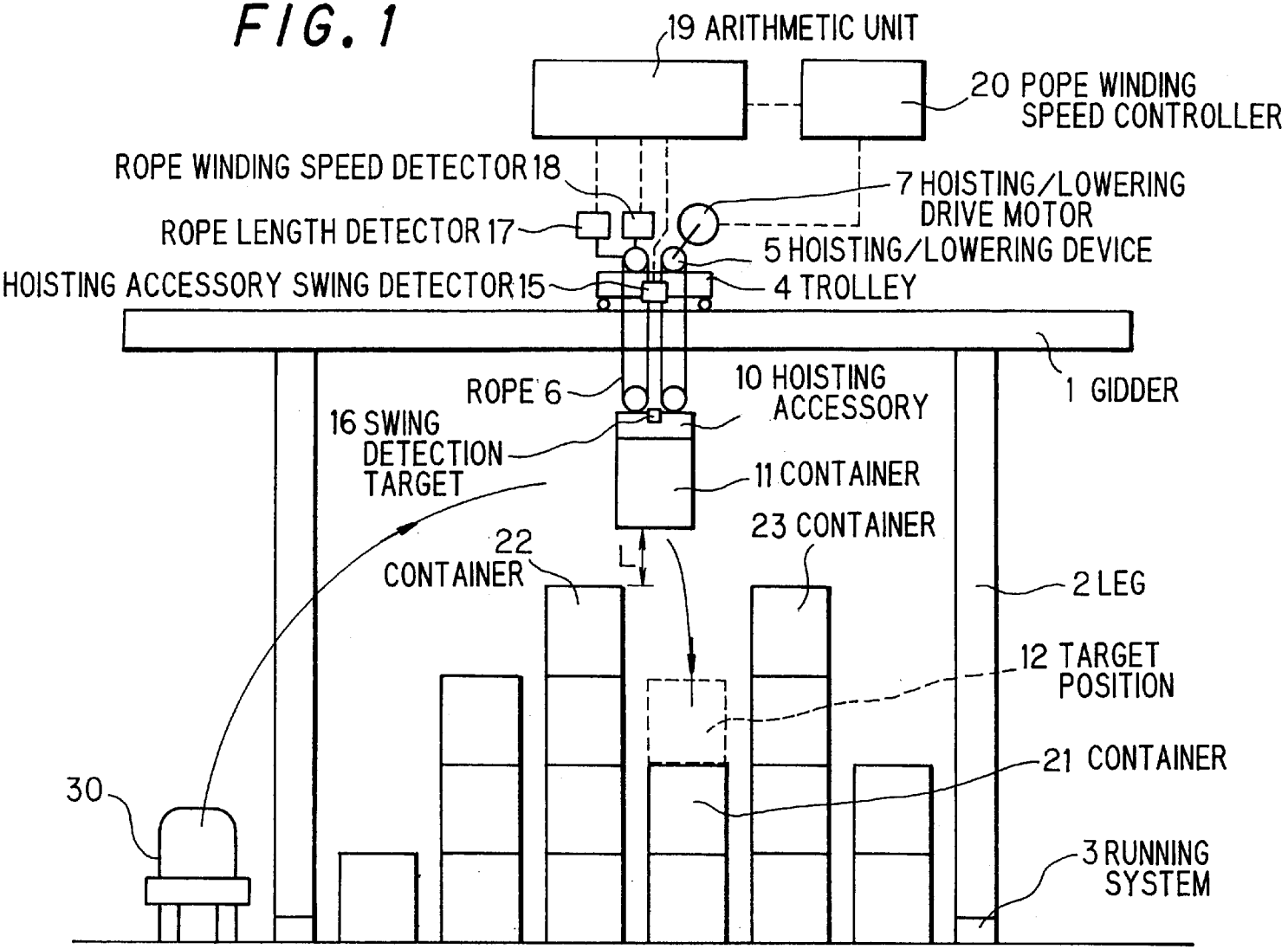
FIG. 1 is an explanation drawing showing the constitution of a container handling crane equipped with a lowering collision avoidance device concerned with an embodiment of the present invention.
Figure 2:
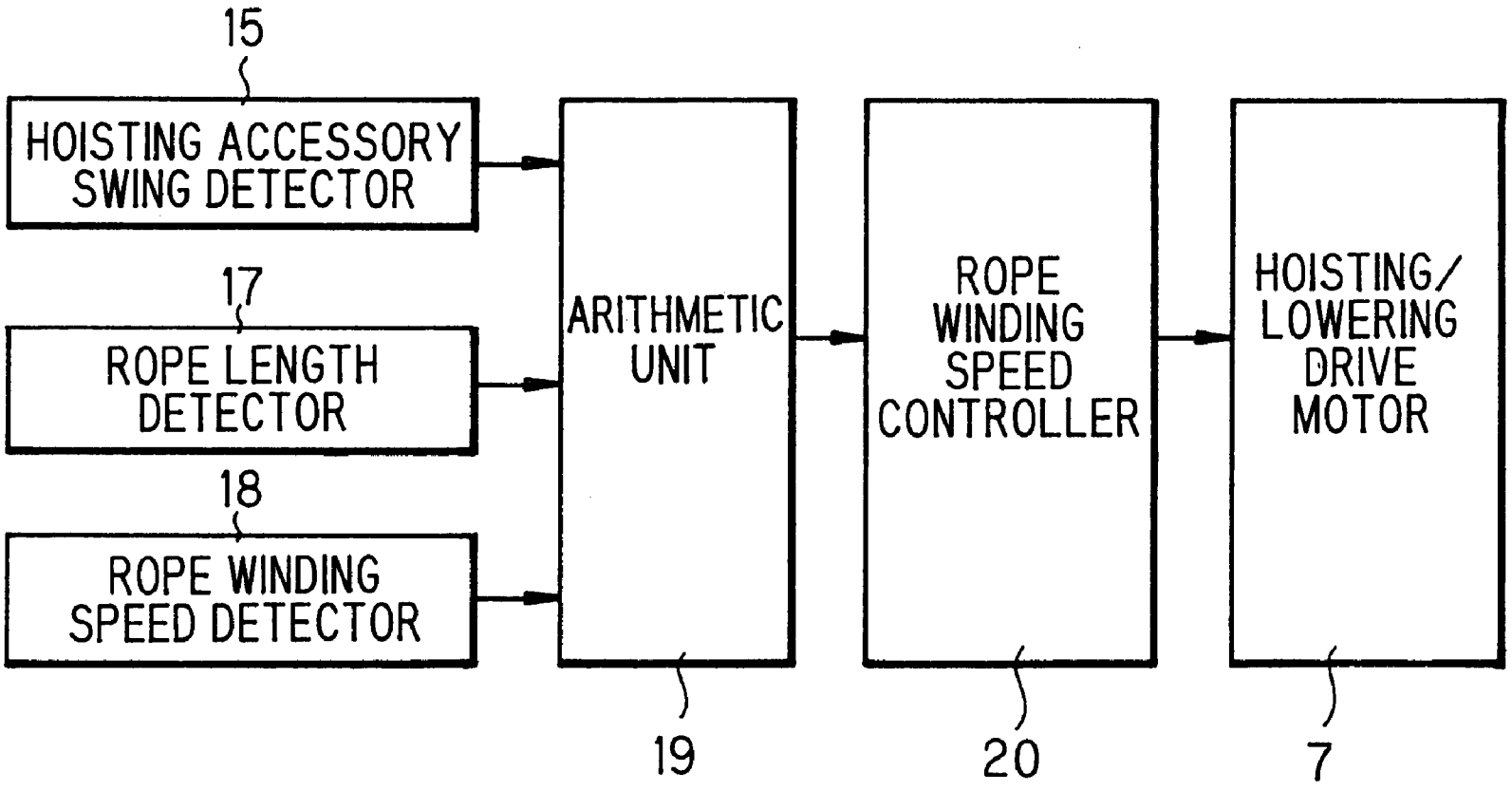
FIG. 2 is a block diagram of a control system in the container handling crane shown in FIG. 1.

FIG. 1 is an explanation drawing showing the constitution of a container handling crane equipped with a lowering collision avoidance device concerned with an embodiment of the present invention. FIG. 2 is a block diagram of a control system in the container handling crane shown in FIG. 1.

As shown in FIG. 1, a container handling crane has a structure comprising a girder 1, legs 2 and running systems 3, a trolley 4, a hoisting/lowering device 5, a hoisting/lowering drive motor 7, a rope 6, a hoisting accessory 10, and a rope winding speed controller 20.

The hoisting accessory 10 is provided with a swing detection target 16 comprising a marking plate, an LED or a laser light source. The trolley 4 is equipped with a hoisting accessory swing detector 15 such as a CCD camera ora PSDcamera. The hoisting/lowering device 5 is provided with a rope length detector 17 and a rope winding speed detector 18 which are usually installed. The rope length detector 17 detects the length of the rope 6, while the rope winding speed detector 18 detects the winding speed (i.e., the hoisting or lowering speed) of the rope 6.

As shown in FIGS. 1 and 2, a detection signal from the hoisting accessory swing detector 15, a detection signal from the rope length detector 17, and a detection signal from the rope winding speed detector 18 are entered in an arithmetic unit 19. Basedon these detection signals, the arithmetic unit 19 computes a command value for the lowering speed of the hoisting accessory 10 (i.e. the container) and issues it to the rope winding speed controller 20. The details of this action will be offered later on.

Based on the command value produced by the arithmetic unit 19, the rope winding speed controller 20 controls the hoisting/lowering drive motor 7 to control the lowering speed of the hoisting accessory 10.

Concretely, this control system performs control in the following manner:

① To control the lowering speed of the hoisting accessory 10, a threshold level is set for the amount of swing of the hoisting accessory 10 (hereinafter simply referred to as the amount of swing).

② When the amount of swing of the hoisting accessory detected by the hoisting accessory swing detector 15 is not more than the threshold level, or when the amount of swing is more than the threshold level, but this amount of swing changes in a direction in which the corresponding displacement from a predetermined position decreases, an operation is performed at a normal lowering speed.

③ When the amount of swing is more than the threshold level and also this amount of swing changes in a direction in which the corresponding displacement from the predetermined position increases, the lowering speed is decreased at a predetermined deceleration.

The remaining lowering distance (L in FIG. 1) is always monitored so that if the lowering speed is decreased at a predetermined deceleration, the lowering can be stopped before intrusion into a canyon. The remaining lowering distance is determined in the following manner: On the girder 1, a rangefinder (not shown) is mounted so as to be positioned directly above each stack of the containers. These rangefinders detect the distance from the girder 1 to the top of each stack of containers. The altitudinal position of the container being carried, on the other hand, is detected by the rope length detector 17. The height of one container is already known. Thus, the remaining lowering distance is calculated from detection signals for both detections.

One threshold level is used above. In case two threshold levels are set, control is performed as follows:

① To control the lowering speed of the hoisting accessory 10, threshold levels, $D_1$ and $D_2$, are set for the amount of swing of the hoisting accessory 10, with $D_1<D_2$. Hereinbelow, the magnitude of the amount of swing is designated as D.

② When the amount of swing, D, is not more than the threshold level $D_1$, or when the amount of swing, D, is more than $D_1$ but not more than $D_2$, and this amount of swing changes in a direction in which the corresponding displacement from a predetermined position decreases, an operation is performed at a normal lowering speed.

③ When the amount of swing, D, is more than $D_1$ and not more than $D_2$, and also this amount of swing changes in a direction in which the corresponding displacement from the predetermined position increases, or when the amount of swing, D, is more than $D_2$, but this amount of swing, D, changes in a direction in which the corresponding displacement from the predetermined position decreases, a lowering action is continued if the remaining lowering distance is greater than a normal stopping distance. Once the remaining lowering distance equals the normal stopping distance, the lowering speed is decreased at a predetermined deceleration.

④ When the amount of swing, D, is more than $D_2$ and also this amount of swing changes in a direction in which the corresponding displacement from the predetermined position increases, lowering is stopped immediately.

To ensure further safety, the following positional prediction-based control is combined with the foregoing control:

A threshold level $D_3$ is set, and maximum displacement by the current swing is predicted from computations based on the current amount of swing (i.e., the amount of displacement from a predetermined position) detected by the hoisting accessory swing detector 15, the positional change rate computed from this amount of swing, and the period of vibration of the hoisting accessory computed from the current rope length detected by the rope length detector 17. If the predicted maximum displacement by swing is more than the threshold level $D_3$, the lowering speed is decreased.

Figure 3:
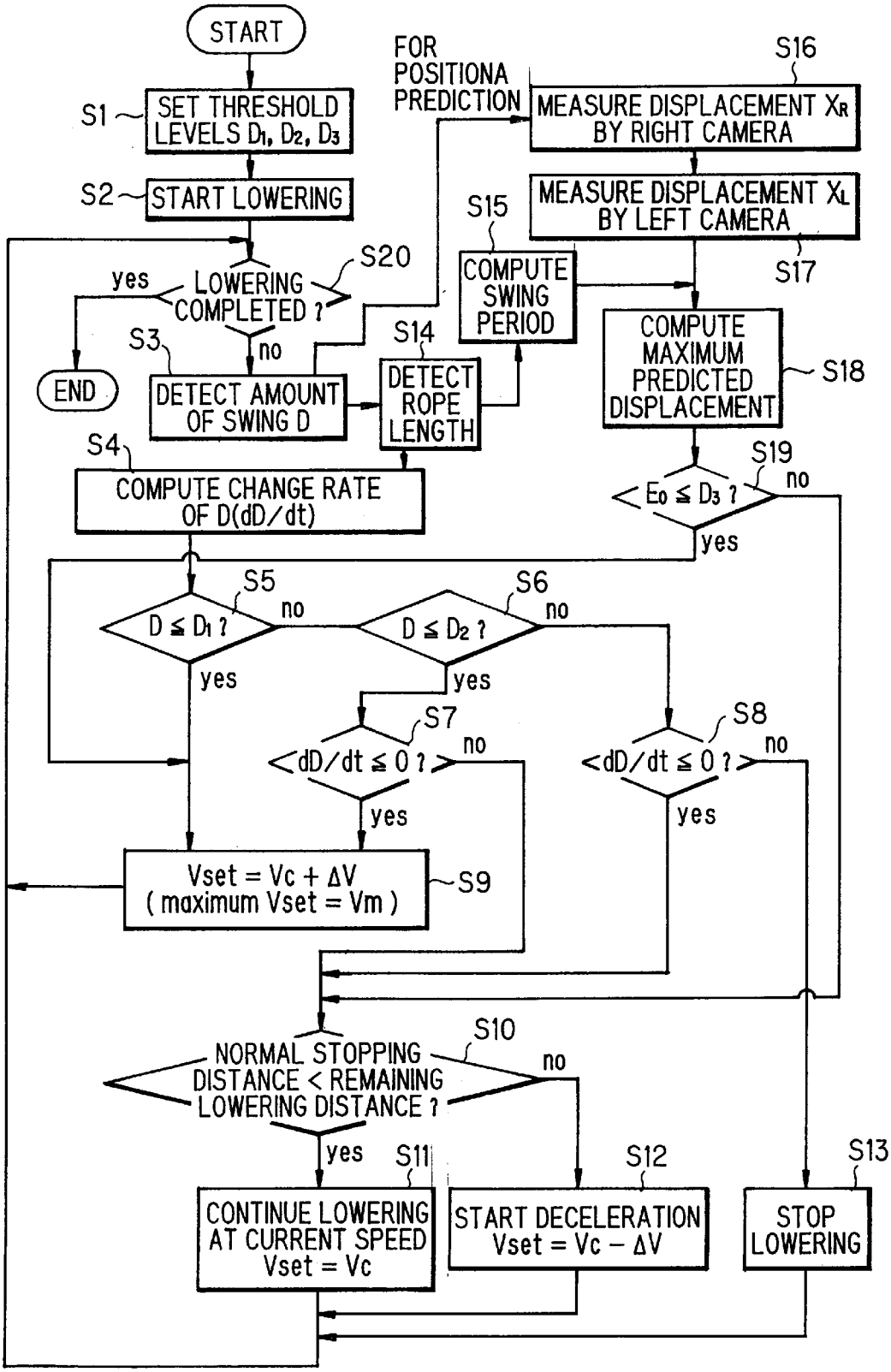
FIG. 3 is a flow chart showing the actions of the lowering collision avoidance device concerned with the embodiment of the invention.
Figure 4:
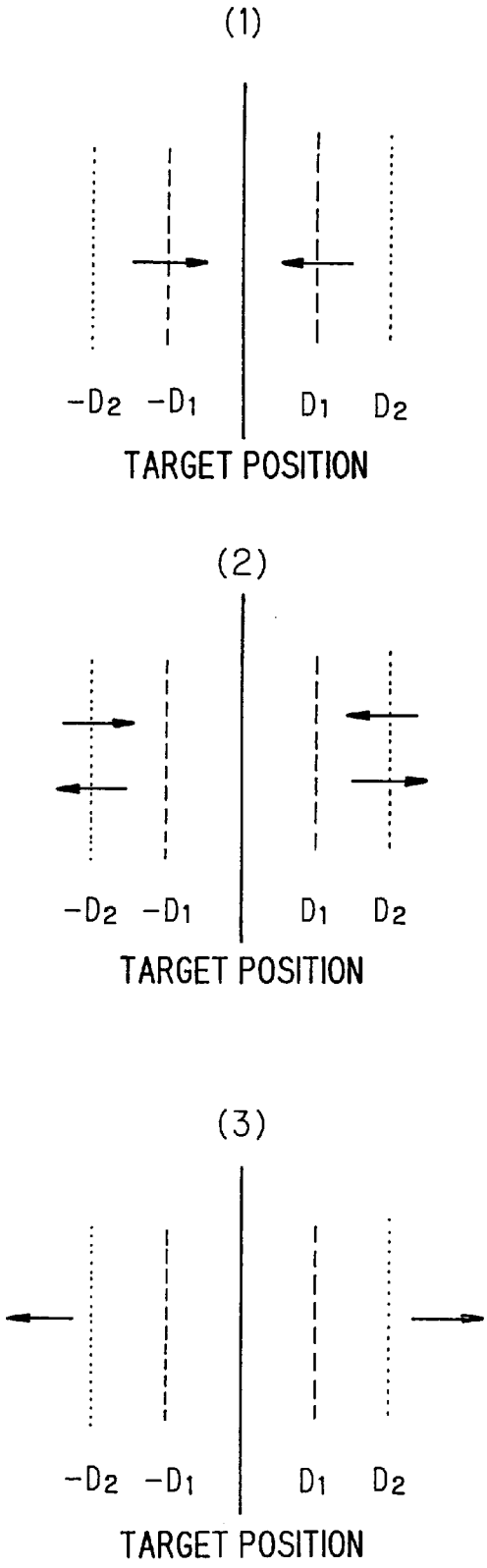
FIG. 4 is an explanation drawing, as viewed from above the container, of different types of operation according to the amount of swing and the direction of changes in the amount of swing in the threshold level-based control of the lowering collision avoidance device concerned with the embodiment of the invention.
Figure 5:
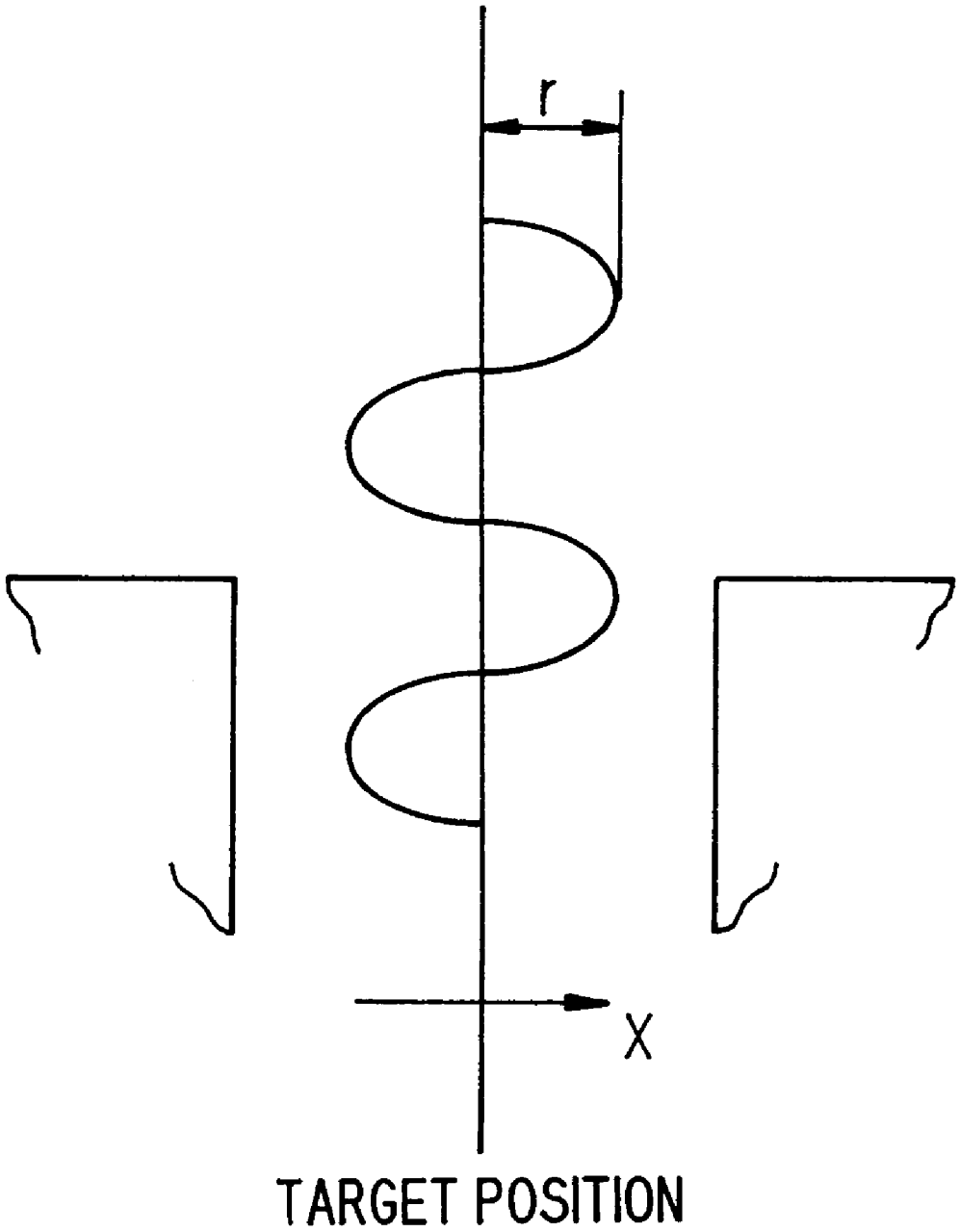
FIG. 5 is an explanation drawing on the positional prediction-based control of the lowering collision avoidance device concerned with the embodiment of the invention.

The logic of a commercial machine adopted by the inventors will be described based on FIGS. 3, 4 and 5. This commercial machine controls the lowering speed according to both of the following logics, A (threshold level-based control) and B (positional prediction-based control). FIG. 3 is a flow chart showing the actions of the lowering collision avoidance device concerned with the embodiment of the invention. In this drawing, the respective parts are assigned the symbols S1 to S20. FIG. 4 isanexplanation drawing, as viewed from above the container, of different types of operation according to the amount of swing and the direction of changes in the amount of swing in the threshold level-based control of the lowering collision avoidance device concerned with the embodiment of the invention. FIG. 5 is an explanation drawing on the positional prediction-based control of the lowering collision avoidance device concerned with the embodiment of the invention.

<A. Threshold level-based control>

To control the lowering speed of the hoisting accessory, two threshold levels, $D_1$ and $D_2$, are set (S1 of FIG. 3). These threshold levels $D_1$ and $D_2$ are set, for example, at $D_1$=30 mm and $D_2$=60 mm. The lowering of the hoisting accessory (i.e. container) is started, and the amount of swing, D, is detected (S2, S3). The change rate of the amount of swing D is computed (S4), and comparisons between the detected amount of swing D and the threshold level $D_1$ or $D_2$, and the change rate of the amount of swing D are considered as follows:

① When $D_1<|D|\leqq D_2$ & $d|/dt\leqq 0$ or $|D|\leqq D_1$, namely, in the condition shown in FIG. 4(1), a command value for the lowering speed is set as follows (see FIGS. S5, S6, S7 and S9 in FIG. 3):

$$Vset=Vc+\Delta V$$

(Maximum value of Vset=Vm)

where Vset: Command value for lowering speed

Vc: Current value of lowering speed

Vm: Predetermined lowering speed

ΔV: Speed increment at each scanning time point

② When $D_1<|D|\leqq D_2$ & $d|D|/dt>0$ or $|D|>D_2$ & $d|D|/dt\leqq 0$, namely, in the condition shown in FIG. 4(2), a command value for the lowering speed is set as follows (see FIGS. S5, S6, S7, S8, S10, S11 and S12 in FIG. 3):

If a distance more than a normal stopping distance remains,

Vset=Vc

If a distance more than a normal stopping distance does not remain, $$Vset=Vc-\Delta V$$

Minimum value of Vset=0

③ When $|D|>D_2$ & $d|D|/dt>0$, namely, in the condition shown in FIG. 4(3), lowering is stopped (see S6, S8 and S13 in FIG. 3).

④ Under other conditions, the logic ③ is given priority.

<B. Positional prediction-based control>

Positional prediction, as stated previously, means predicting maximum displacement by swing in the current status. In other words, if the current swing continues, the hoisting accessory moves downward in the range of the maximum displacement predicted. Hence, when the predicted maximum displacement by swing (details of the predicting method will be offered later on) is larger than a threshold level $D_3$ (e.g., ±110 mm) set separately from the threshold levels $D_1$ and $D_2$ (see S1 in FIG. 3), the lowering speed is reduced in the following manner (see S10, S11, S12, S14, S15, S16, S17, S18 and S19 in FIG. 3):

$$Vset=Vc-\Delta V$$

Minimum value of Vset=0

The method of positional prediction will be described in detail below.

1 Principle of positional prediction

The movement of the hoisting accessory (swing) is assumed as a simple harmonic motion. The amplitude of the hoisting accessory can be calculated from the position of the hoisting accessory (the amount of displacement from the predetermined position), the positional change rate, and the period of vibration as mentioned previously. The position of the hoisting accessory can be calculated using the detected values, while the positional change rate can be calculated from the detected values of position at each moment. The period of vibration can be calculated from the detected values of the rope length. The relevant equations will be given below.

As shown in FIG. 5, the displacement of the hoisting accessory is represented by the equation ① where $X_0$ denotes the coordinates of the target position.

$$X=X_0+r\sin\omega t \quad ①$$

The differential of first order for the equation ① is represented by the equation ②.

$$x'=r\omega\cos\omega t \quad ②$$

Thus, the amplitude r of the hoisting accessory is represented by the equation ③.

$$r=\sqrt{(X-X_0)^2+\left(\frac{X\prime}{\omega}\right)^2} \quad ③$$

For a parallel swing, co is represented by the equation ④.

$$\omega=\sqrt{\frac{g}{L}} \quad ④$$

Thus, the functional form of the equation ① can be determined.

For a skew swing, i.e., a torsional swing, the equation ⑤ is used in place of the equation ④.

$$\omega=\sqrt{\frac{mgd^2}{4IL}} \quad ⑤$$

where I: Moment of inertia
m: Weight
L: Rope length
d: Distance between fulcrums (2) Positional prediction The prediction of maximum displacement is carried out in the following manner:

Let
$X_R$: Measured value of displacement by right camera
$X_L$: Measured value of displacement by left camera The displacement $X_R$ or $X_L$ is a composite vibration comprising a parallel swing and a skew swing, and thus, is not considered to be a simple harmonic motion. Hence, $X_R$ and $X_L$ are each reformed into the following equation for reduction into a parallel swing and a skew swing which are considered simple harmonic motions.

$$X_1=\frac{X_R+X_L}{2}:\text{Parallel swing}$$

$$X2=\frac{X_R+X_L}{2}:\text{Skew swing}$$

The displacements $X_1$ and $X_2$ can be determined by the method described in (1) above. The periods of parallel swing and skew swing are different from each other. The functional forms of the original displacements $X_R$ and $X_L$ can be calculated from $X_1$ and $X_2$ by the above-described method.

$$X_R=X_1+X_2$$

$$X_L=X_1-X_2$$

The predicted maximum displacement $E_0$ is calculated as follows:

$$E_R=\text{Max}\{X_R\}$$

$E_R$: Maximum predicted displacement measured by right camera $$E_L=\text{Max}\{X_L\}$$

$E_L$: Maximum predicted displacement measured by left camera $$E_0\ \text{Max}\{E_R,E_L\}$$

The calculations for the logics of A and B above are made continuously at each scanning time point from the time when the bottom surface or the suspended container comes to a predetermined height above the entrance of the canyon, for example, 4 m above, or from the time when the trolley comes to a predetermined horizontal position apart from the entrance of the canyon, for example, within 1 meter, to the time when the container arrives at the floor (or is placed on the stack of containers in layers). According to these logics, the calculations are made at each scanning time point using the detected values of the rope length. Thus, it can be said that changes in the rope length during swing are taken into consideration.

When the container is placed on the stack of containers (or placed on the floor) to lessen the load on the hoisting accessory 10, a spring-supported rod (not shown) moves upward to turn off a limit switch (not shown). Based on this action, it is determined whether the lowering has been completed or not (see S20 in FIG. 3).

By installing the lowering collision avoidance device concerned with the instant embodiment on a container handling crane, therefore, even if the current swing of the hoisting accessory 10 (i.e., the swing of the container 11) is marked, the lowering speed need not be decreased, when the swing decreases during the lowering of the container 11. Moreover, continued operation can be carried out to the extent that the container 11 will not collide with the adjacent containers 22 and 23. In case a real risk of collision exists, the lowering can be stopped. Thus, the cycle time can be shortened safely.

The lowering collision avoidance device according to the present invention is installed on a commercial machine for practical use, and is operated satisfactorily. Thus, its effectiveness has been demonstrated.

As explained concretely above along with the embodiment of the invention, the lowering collision avoidance device as the first aspect of the invention skillfully utilizes the facts that a carried article, such as a container, suspended by a rope vibrates with a long period like a pendulum and cannot cause abrupt changes in position owing to its inertia. By so doing, the device controls the lowering speed based on the results of comparison between the amount of swing of the hoisting accessory and a threshold level or a plurality of threshold levels, the direction of changes in the amount of swing of the hoisting accessory, and the lowering speed. Assume, here, that a carried article is lowered, together with the hoisting accessory, to be placed on a stack of containers in layers or on the floor at a site where there are obstacles such as carried articles stacked adjacently in layers. At this time, when the swing of the hoisting accessory decreases during the lowering of the carried article even if the current swing of the hoisting accessory (i.e., the current swing of the carried article) is marked, the lowering speed need not be reduced. Moreover, maximum continued operation can be carried out to the extent that the carried article will not collide with the adjacent obstacle. In case a real risk of collision exists, the lowering of the carried article can be stopped. This enables the cycle time to be shortened safely.

According to the lowering collision avoidance device as the second aspect of the invention, maximum displacement by the swing of the hoisting accessory is predicted. Based on the results of comparison between the predicted maximum displacement by swing and a predetermined threshold level, the lowering speed is controlled. Thus, collision between the lowered carried article and the adjacent obstacle can be prevented more reliably.

We claim:

1. A lowering collision avoidance device of a crane, said crane comprising:

a rope attached to said crane and capable of being taken up or paid out by said crane;

a hoisting accessory suspended from said rope and hoisted or lowered by said crane;

a hoisting accessory swing detector for detecting a swing of said hoisting accessory and generating swing information therefrom;

a speed detector for detecting a lowering speed of said hoisting accessory; and a controller for receiving said swing information and said lowering speed, wherein said controller controls said lowering speed of said hoisting accessory based on said lowering speed detected by said speed detector, a change in swing amplitude, and a comparison between said swing of said hoisting accessory and a predetermined threshold level.

2. The lowering collision avoidance device of a crane as recited in claim 1, wherein said swing detector further includes a rope length detector for detecting a length of said rope.

3. The lowering collision avoidance device of a crane as recited in claim 2, wherein said controller may use said rope length detector to determine a maximum swing displacement, a swing velocity, and a swing period of vibration.

4. The lowering collision avoidance device of a crane as recited in claim 1, wherein said controller decreases said lowering speed when said detected swing exceeds said predetermined threshold.

5. The lowering collision avoidance device of a crane as recited in claim 1, wherein said controller predicts a maximum displacement of said hoisting accessory based on:

a computed positional change rate of said detected swing of said hoisting accessory; and a period of vibration of said detected swing for said hoisting accessory computed from the rope length, wherein said controller controls said lowering speed based on said predicted maximum swing displacement and a predetermined swing threshold level, thereby controlling the lowering speed of said hoisting accessory.

6. The lowering collision avoidance device of a crane as recited in claim 1, wherein said swing detector further comprises:

a swing detection target affixed to said hoisting accessory;

a light source affixed to said crane and capable of illuminating said swing detection target; and a camera affixed to said crane, said camera detects a hoisting accessory swing amplitude and a hoisting accessory position by receiving light reflected from said swing detection target, wherein said camera communicates said hoisting accessory swing amplitude and said hoisting accessory position to said controller.

7. The lowering collision avoidance device of a crane as recited in claim 1, wherein said predetermined threshold comprises a plurality of predetermined thresholds.

8. A lowering collision avoidance device of a crane, said crane comprising:

a rope attached to said crane and capable of being taken up or paid out by said crane;

a hoisting accessory suspended from said rope and hoisted or lowered by said crane;

a swing detection target affixed to said hoisting accessory;

a light source affixed to said crane and capable of illuminating said swing detection target;

a camera affixed to said crane, said camera detects a hoisting accessory swing amplitude and a hoisting accessory position by receiving light reflected from said swing detection target;

a speed detector for detecting a lowering speed of said hoisting accessory; and a controller for receiving said hoisting accessory swing amplitude, said hoisting accessory position and said lowering speed, wherein said controller controls said lowering speed of said hoisting accessory based on a change in swing amplitude, said lowering speed detected by said speed detector, and a comparison between a detected swing of the hoisting accessory and a predetermined threshold level.

9. The lowering collision avoidance device of a crane as recited in claim 8, wherein said predetermined threshold comprises a plurality of predetermined thresholds.

10. The lowering collision avoidance device of a crane as recited in claim 8, wherein said controller predicts a maximum swing displacement of said hoisting accessory based on:

a computed positional change rate of said detected swing of said hoisting accessory; and a period of vibration of said detected swing for said hoisting accessory computed from the rope length, wherein said controller controls said lowering speed based on said predicted maximum swing displacement and a predetermined swing threshold level, thereby controlling the lowering speed of said hoisting accessory.

* * * * *